United States Patent [19]

Lasenga

[11] Patent Number: 4,958,404

[45] Date of Patent: Sep. 25, 1990

[54] CARD FOR PRODUCING FIBROUS WEBS ETC.

[75] Inventor: Werner Lasenga, Duelmen, Fed. Rep. of Germany

[73] Assignee: Hergeth Hollingsworth GmbH, Duelmen, Fed. Rep. of Germany

[21] Appl. No.: 252,335

[22] Filed: Sep. 30, 1988

[30] Foreign Application Priority Data

Oct. 10, 1987 [DE] Fed. Rep. of Germany ..... 3734313

[51] Int. Cl.[5] ..... D01G 15/74; D01G 15/28

[52] U.S. Cl. ..... 19/98; 19/95; 19/105

[58] Field of Search ..... 19/95, 96, 98, 105, 19/106 P, 65 R, 145.7, 296, 300

[56] References Cited

U.S. PATENT DOCUMENTS

| | | | |
|---|---|---|---|
| 3,685,099 | 8/1972 | Jenkins | 19/95 |
| 4,008,511 | 2/1977 | Oda | 19/105 |
| 4,366,601 | 1/1983 | Beneke | 19/98 |
| 4,523,350 | 6/1985 | Schmeidgen et al. | 19/300 X |
| 4,524,492 | 6/1985 | Elliott | 19/95 X |
| 4,542,560 | 9/1985 | Tooka et al. | 19/98 |
| 4,583,267 | 4/1986 | Fehrer | 19/99 |
| 4,615,080 | 10/1986 | Wirth | 19/106 R |
| 4,797,978 | 1/1989 | Giuliani | 19/98 |

*Primary Examiner*—Donald Watkins
*Attorney, Agent, or Firm*—Cort Flint

[57] ABSTRACT

A card for producing fibrous webs or random webs of textile fibers comprises a plurality of cylinders in series with metallic wire. The cylinders rotate in a predetermined mutual sense to which worker rolls are coordinated. The cylinders and workers are covered by trough-shaped plates. The trough-shaped cover of the cylinders or workers (7, 8, 9) is formed of a plurality of trough sections (**20*a*, 20*b*, 20*c*, 20*d*, 20*e***) which are arranged in close succession. The trough sections are adapted to be adjustable and to be opened respectively. By this means, a control of the optimum air amount at the rollers may be achieved uniformly over the working width.

6 Claims, 2 Drawing Sheets

CARD FOR PRODUCING FIBROUS WEBS ETC.

BACKGROUND OF THE INVENTION

The invention relates to a card for producing fibrous textile webs and random webs of natural or synthetic fibers. The card comprises a series of cylinders clothed with metallic wire which rotate in a predetermined sense with respect to each other. A plurality of working rollers are coordinated with the cylinders for working the fibers. A roller and feed plate feed the fibers and at least one takeoff roller takes off the fibers. The cylinders and the workers are covered by trough-shaped plates.

It has been known to use closed undercasings in cards such as random web cards, under carding cylinders and licker-in roller to prevent accidental air movements and negative influences. Further, dirt deposits on the driving units frequently arranged beneath the rollers are prevented. It also has been known to use interrupted undercasings with slots to remove trash particles, etc., beneath rollers within the licker-in range when the rollers have teeth points inclined in the sense of rotation (positively inclined metallic wire).

With the use of arcuate undercasings which are produced more and more accurately in order to obtain a more uniform final product, the optimum air amount may not be available for the formation of the air current entrained by the roller when operational conditions change, i.e. changes in fiber material, In the absence of sufficient air, the system absorbs air in an uncontrollable manner. An unequal pressure distribution is caused over the working width from one roller end to the other. A nonuniform fiber distribution is produced accordingly. On the other hand, the presence of too much air may entail a formation of alleys, i.e. streaks and thin places in the material.

Accordingly, an object of the present invention is to provide a card having a regulation and control of the air balance around the rollers.

SUMMARY OF THE INVENTION

The invention is characterized in that the trough-shaped cover of the cylinders and/or workers is formed of a series of trough sections arranged in spaced relationship which are adapted to be selectively opened.

If the roller cover is designed this way, a control of the optimum air amount for the cylinders and/or rollers may be easily performed uniformly over the working width. An optimum adjustment of the air current causes a stabilization and a uniform distribution of the material entrained by the rollers. The quality of a nonwoven product or of another fibrous web may be substantially improved. At the same time, the fiber throughput may be increased and an optimum quality of the fibrous web may be obtained simultaneously.

According to another feature of the invention, the trough sections are adapted to be tilted outwardly from the cylinder or roller. The trough sections which may be tilted away, are suitably adapted to be opened to a nearly radial extension. The angle of opening of the trough sections may be limited by a stop. The opening of the trough sections may be controlled individually and/or in common, e.g. by groups.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
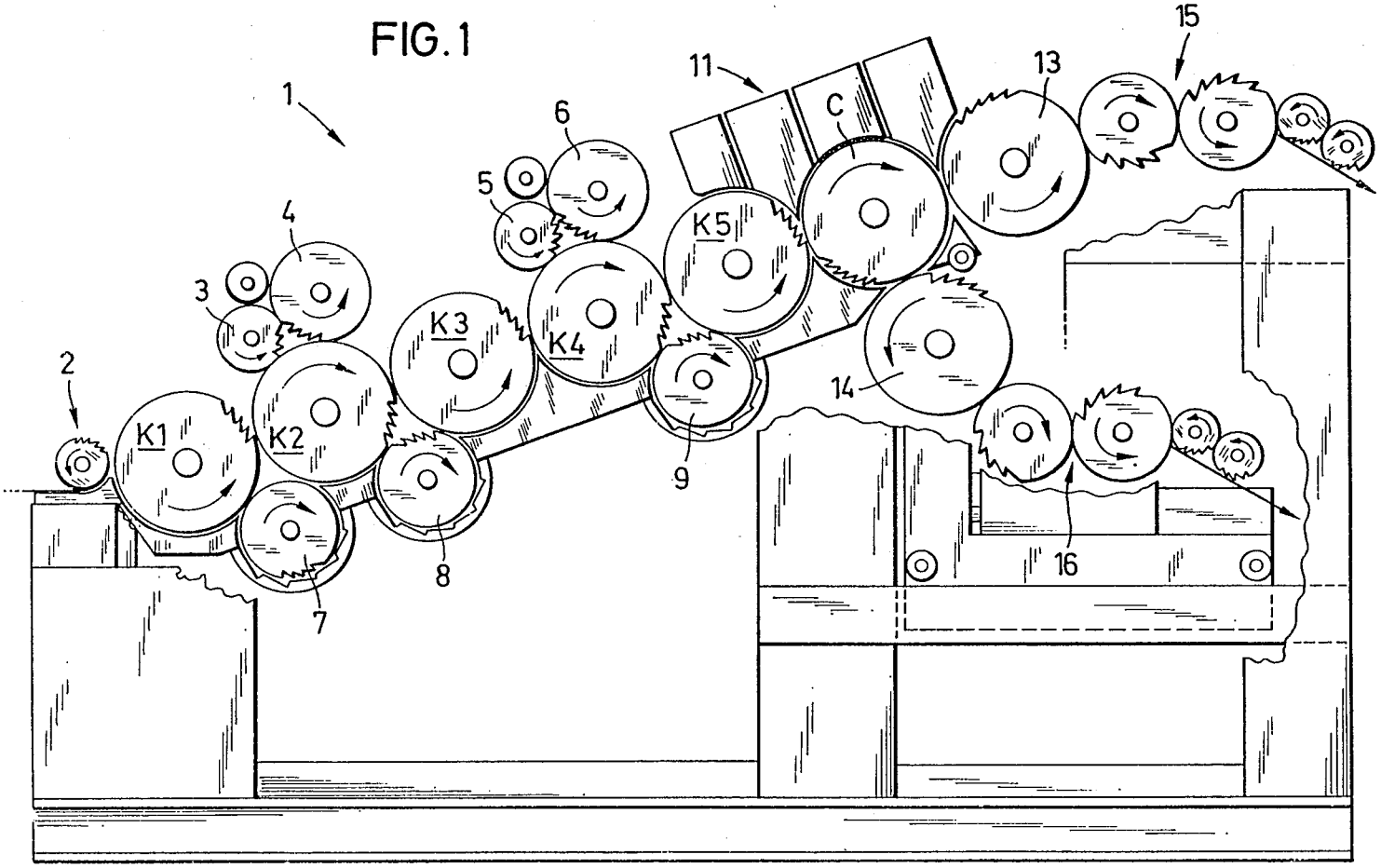
FIG. 1 is an elevational and schematic view of an embodiment of a card of the invention.
Figure 2:
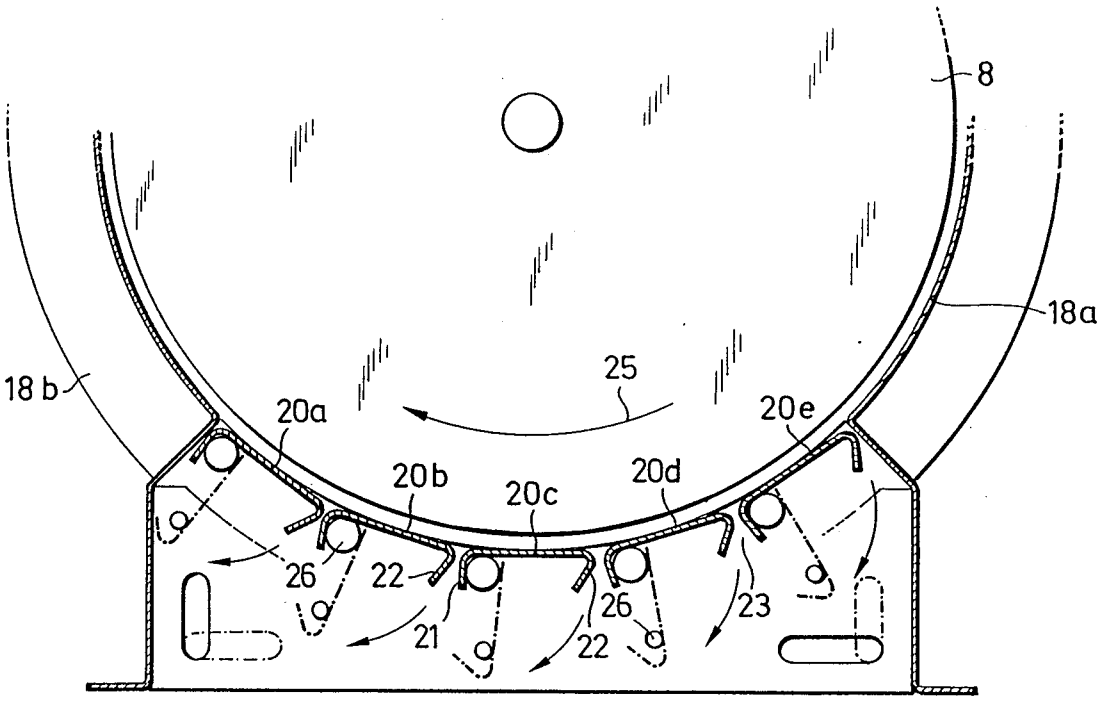
FIG. 2 is a roller, in particular a worker, comprising the cover of the invention, in detail and schematically.

Referring now in more detail to the drawings, a random web card, designated generally as 1, is illustrated which comprises an undercasing intake 2 which also may be an intake roller, five carding cylinders K1 to K5, a drum C and seven coordinated workers or clearer rollers 3 to 9. A centrifugal-dynamic web formation means 11 is followed by take-off rollers 13 and 14. If necessary, a stuffing means 15 or 16 is provided on the upper take-off roller or on both of them. As can best be seen in FIG. 2, a division of the undercasing **18*a* and 18*b* is preferably provided near workers and can also be provided near carding cylinders K1 to K5 7, 8, and 9 and/or near drum C. Between casing parts 18*a* and 19*b*, the cover of roller 8 is formed of a plurality of trough sections 20*a*, 20*b*, 20*c*, 20*d*, 20*e* arranged in series. The sectional portions are designed to be adjustable and adapted to be opened. The undercasing for the other worker rollers is constructed likewise. The longitudinal sides of each trough section 20*a*, 20*b*, 20*c*, 20*d*, 20*e* are provided with outwardly directed angular elements 21, 22. The angular elements of two adjacent sectional portions form an outwardly flared gap 23. The trough sections are pivotally supported about a shaft 26 at an edge situated rearwardly in the sense of rotation 25 of roller 8. The trough sections are adapted to be tilted away and opened to a nearly radial extension such as indicated by positions in short lines. The angle of opening of the trough sections may be limited by a stop 26*a*. For the formation of the enlarged gap 23, the angular element 22 is directed inwardly beyond 90 degrees at the leading edge of the trough section, as seen in the sense of rotation 25**.

Due to the trough sections **20*a*, 20*b*, 20*c*, 20*d*, 20*e* adapted to be opened more or less, the air balance at the workers may be regulated according to the prevailing demand. By the arrangement of the axis of rotation 26** and the design of the trough sections, the setting angle may be selected within a wide range. Since several workers are provided with the controllable undercasing, the air balance may be controlled at one or several sites. Their movements may be controlled individually and/or in common. The teeth of the metallic wire of the workers are always directed opposite to the sense of rotation. Due to the various possibilities of control, the air balance may be regulated for the plurality of carding rollers in such a way that a uniform pressure distribution may be maintained which ensures a uniform fiber distribution.

While a preferred embodiment of the invention has been described using specific terms, such description is for illustrative purposes only, and it is to be understood that changes and variations may be made without departing from the spirit or scope of the following claims.

What is claimed is:

1. A textile card for producing fibrous webs and random webs of textile fibers comprising a series of cylinders fitted with metallic wire which rotate relative to each other in a predetermined sense, and a plurality of worker rollers coordinated with said cylinders, a fiber intake and, at least one take-off roller, said worker rollers including a trough shaped cover which includes trough-shaped plates, and said cover containing an opening for regulating the air current between said rollers and said cover, characterized in that said trough-shaped cover of said worker rollers is formed of a plurality of trough sections arranged in spaced series relationship, and means for opening said trough sections to provide a desired air flow around said cylinder and rollers.

2. The card of claim 1 wherein said means for opening said trough sections includes pivotal means for mounting said trough sections for tilting outwardly away from said roller.

3. The card of claim 2 wherein said pivotal means tilts said trough sections to a nearly radial extension.

4. The card of claim 2 including a stop for limiting the angle that said trough sections may be tilted outwardly.

5. The card of claim 1 wherein the open condition of said trough sections is controllable individually.

6. The card of claim 1 including a space between adjacent trough sections, and an outwardly flaring gap defined in said space by opposing inclined edges of said adjacent trough sections.

* * * * *